US007503545B2

(12) United States Patent
Verbowski

(10) Patent No.: US 7,503,545 B2
(45) Date of Patent: Mar. 17, 2009

(54) PRY BAR

(76) Inventor: Larry Verbowski, 1875 Freeland Rd., Bay City, MI (US) 48706

( * ) Notice: Subject to any disclaimer, the term of this patent is extended or adjusted under 35 U.S.C. 154(b) by 0 days.

(21) Appl. No.: 12/027,647

(22) Filed: Feb. 7, 2008

(65) Prior Publication Data

US 2008/0191181 A1 Aug. 14, 2008

Related U.S. Application Data

(60) Provisional application No. 60/888,786, filed on Feb. 8, 2007.

(51) Int. Cl.
*B25C 11/00* (2006.01)

(52) U.S. Cl. ..... 254/25; 254/21

(58) Field of Classification Search ..... 254/25, 254/20, 21; 76/24.1
See application file for complete search history.

(56) References Cited

U.S. PATENT DOCUMENTS

| | | | | |
|---|---|---|---|---|
| 1,355,275 | A | 10/1920 | Schroeder | |
| 1,472,517 | A | 10/1923 | Fry | |
| 2,089,619 | A * | 8/1937 | Ripley | 407/29.1 |
| 2,214,954 | A * | 9/1940 | Crater | 407/29.1 |
| 3,522,932 | A | 8/1970 | Nakasone | |
| 3,587,121 | A | 6/1971 | Morrow | |
| 3,680,834 | A | 8/1972 | Holloway | |
| 3,680,838 | A | 8/1972 | Dunn | |
| D352,220 | S | 11/1994 | Schroeder | |
| 5,865,425 | A * | 2/1999 | Meadows | 254/131 |
| 6,158,100 | A * | 12/2000 | Peterson et al. | 29/267 |
| 6,471,186 | B1 * | 10/2002 | Lawless | 254/25 |
| 6,604,728 | B1 * | 8/2003 | Boydon | 254/25 |
| 2004/0149967 | A1 * | 8/2004 | Puopolo et al. | 254/25 |
| 2004/0155229 | A1 * | 8/2004 | Lawless | 254/25 |
| 2008/0191181 | A1 * | 8/2008 | Verbowski | 254/25 |

* cited by examiner

*Primary Examiner*—Lee D Wilson
(74) *Attorney, Agent, or Firm*—Robert L. Stearns; Dickinson Wright PLLC

(57) ABSTRACT

A pry bar (16) of the type used to move objects through the application of leverage includes a shaft (22) having a roughened surface (24) to increase its coefficient of friction. The roughened surface (24) may extend over an elbowed (28) transition and at least partially over the tip (18). A slip cover (30) is moveably disposed along the shaft (22) into a selective intervening position covering the roughened surface (24) to protect delicate fulcrum points from the roughened surface (24). The slip cover (30) preferably includes a resilient, cantilevered tongue (34) for covering the elbow (28) and a portion of the tip (18). In an alternative embodiment, the slip cover (230, 330) is fitted with a supplemental journaling member (240, 340). In one specific embodiment, the supplemental journaling member (340) includes a roller wheel (346) to provide a rolling interface at the fulcrum point.

20 Claims, 7 Drawing Sheets

PRY BAR

CROSS REFERENCE TO RELATED APPLICATIONS

This application claims priority and full right of benefit to U.S. Provisional Patent Application No. 60/888,786, filed Feb. 8, 2007.

BACKGROUND OF THE INVENTION

1. Field of the Invention

The subject invention relates to pry bars and other types of levering devices used to move stubborn objects and to pry where leverage is needed, and more particularly toward an improved pry bar incorporating strategically roughened surfaces to prevent slippage at the fulcrum point.

2. Related Art

Pry bars are tools, usually made of steel, used to lift and move heavy objects and to pry where leverage is needed. They can also be used to remove nails and spikes if so fitted. The most commonly used types of pry bars include the wrecking bar, crow bar, pinch bar and alignment bar. These pry bar tools typically range from 12 inches to 72 inches in length, depending upon their design and the purpose for which they are used. However, other lengths and configurations may be desirable depending upon the application.

Typically, the pry bar is used by wedging a tip, or working end thereof under the object to be moved. An intermediate surface on the shaft is brought to rest against a stable purchase, which acts as a fulcrum. The user grasps a far, handled end and exerts as much force as needed to move the object. Sometimes, a very large amount of force is needed.

It is often the case that, while force is being exerted to the handle portion of a pry bar, the fulcrum slips from its perch, resulting in an abrupt, unexpected shifting of the handle portion of the pry bar. When this occurs, the user's hand can be inadvertently smashed into a surrounding structure causing injury. Accordingly, there is a long-felt yet unsolved need in this field for a pry bar tool which is less prone to slippage at the fulcrum point when in use.

SUMMARY OF THE INVENTION

The subject invention provides a pry bar tool of the type used to move stubborn objects through the application of leverage. The pry bar comprises a handle portion and an elongated shaft extending from the handle portion. A working tip extends from the shaft, opposite the handle portion. The tip is angled relative to the longitudinal extent of the shaft with an elbow forming a transition between the shaft and the tip. The shaft includes a roughened surface disposed along at least a portion thereof, adjacent the elbow, for increasing the coefficient of friction when the shaft is applied against a fulcrum.

The roughened surface provides a non-slip or slip-resistant region of the pry bar thereby reducing the tendency for the shaft to slip away from its perch, and thereby increase effectiveness and user safety.

According to another aspect of this invention, a pry bar comprises a handle portion, an elongated shaft extending from the handle portion, and a working tip extending from the shalt opposite the handle portion. The tip is angled relative to the longitudinal extent of the shaft with an elbow forming a transition between the shaft and the tip. The shaft includes a roughened surface disposed along at least a portion thereof adjacent the elbow for increasing the coefficient of friction when the shaft is applied against a fulcrum. A slip cover is slidably disclosed along the shaft toward and away from the elbow for selectively covering at least a portion of the roughened surface. The slip cover includes a flexible tongue configured to overlap the elbow.

According to this alternative embodiment, the slip cover provides a protective member which is carried on the shaft and moveable so that its flexible tongue forms a buffer between the roughened surface and the fulcrum. Thus, in situations where the fulcrum is fragile or could otherwise be marred by the roughened surface, the slip cover provides an intermediate shield. However, in situations where an increased coefficient of friction is needed to prevent slippage, the slip cover can be retracted along the length of the shaft thereby exposing the roughened surface and enabling the pry bar for use in the manner described previously.

According to a further embodiment of this invention, a pry bar tool is provided with a roughened surface along at least the convex surface portion of its elbow.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
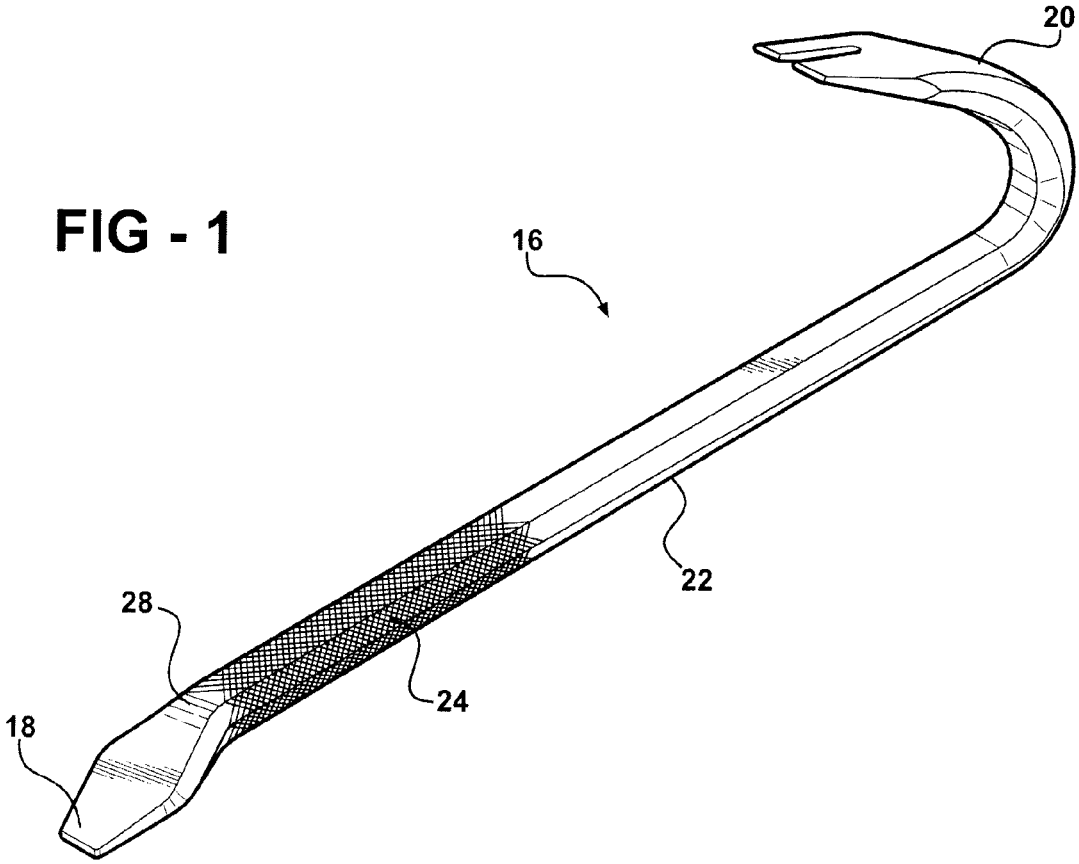
FIG. 1 is a depiction of a common wrecking bar type pry bar according to the subject invention.
Figure 14:
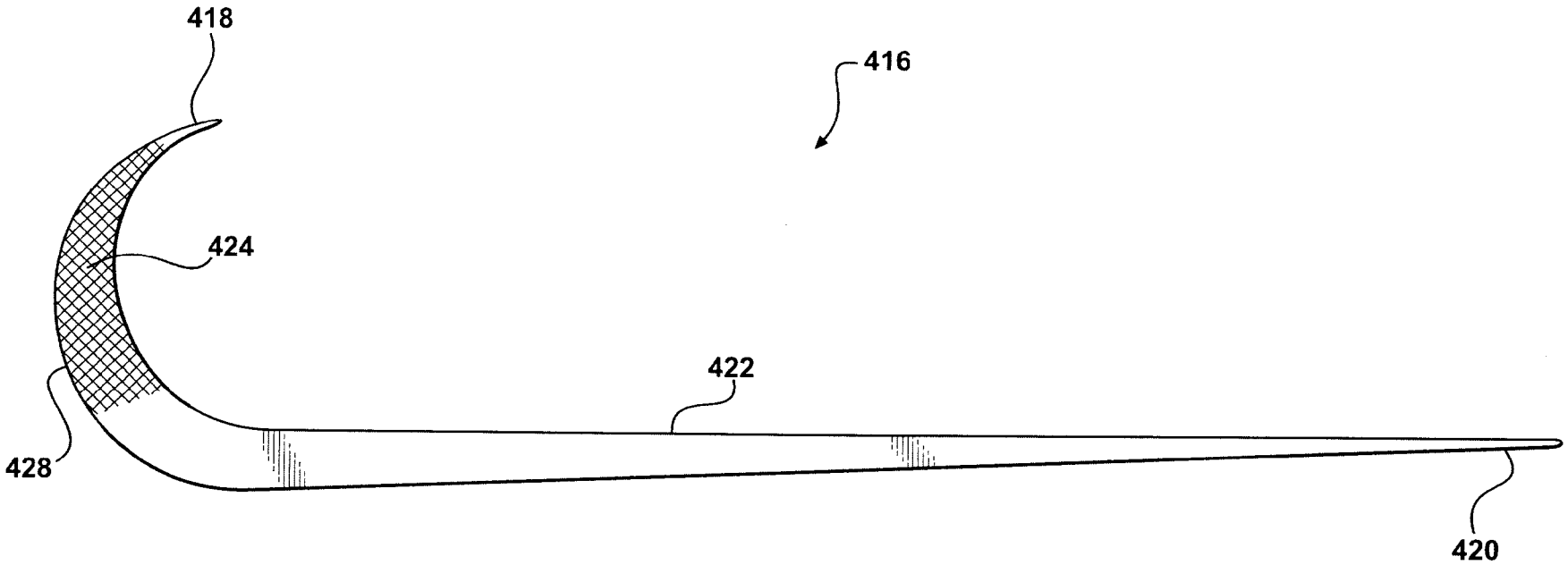
FIG. 14 is a perspective view of a still further alternative configuration for the pry bar wherein the roughened surface is disposed along the convex surface portion of its elbow.

Referring to the Figures, wherein like numerals indicate like or corresponding parts throughout the several views, a pry bar according to the subject invention is generally shown at 16 among the various views. The pry bar 16 is depicted in FIG. 1 to be of the more or less "wrecking bar" type, although the term pry bar is used herein in the generic sense referring to any bar or elongated tool used to lift or move objects through the action of the leverage. The pry bar 16 includes a working end or tip 18 and an opposite handled portion 20. Both the tip 18 and the handle portion 20 can be shaped in various ways for different applications. In some circumstances, the handled portion 20 also serves as a working end of the tool such as a nail pulling device, a pike, or the like. The pry bar 16 includes an elongated shaft 22 extending between the tip 18 and handle portion 20. The shaft 22 may have any suitable cross-sectional configuration, which in FIG. 1 is illustrated as generally hexagonal. Other geometric configurations are of course possible, including rectangular, triangular, rounded and so forth. In the preferred embodiment, however, the shaft 22 has a generally continuous cross-sectional geometry comprising at least four flat faces. Although, the embodiment depicted in FIG. 14 shows a shaft 422 of tapering cross-sectional geometry and is illustrative of the wide variability of pry bar designs.

Figure 2:
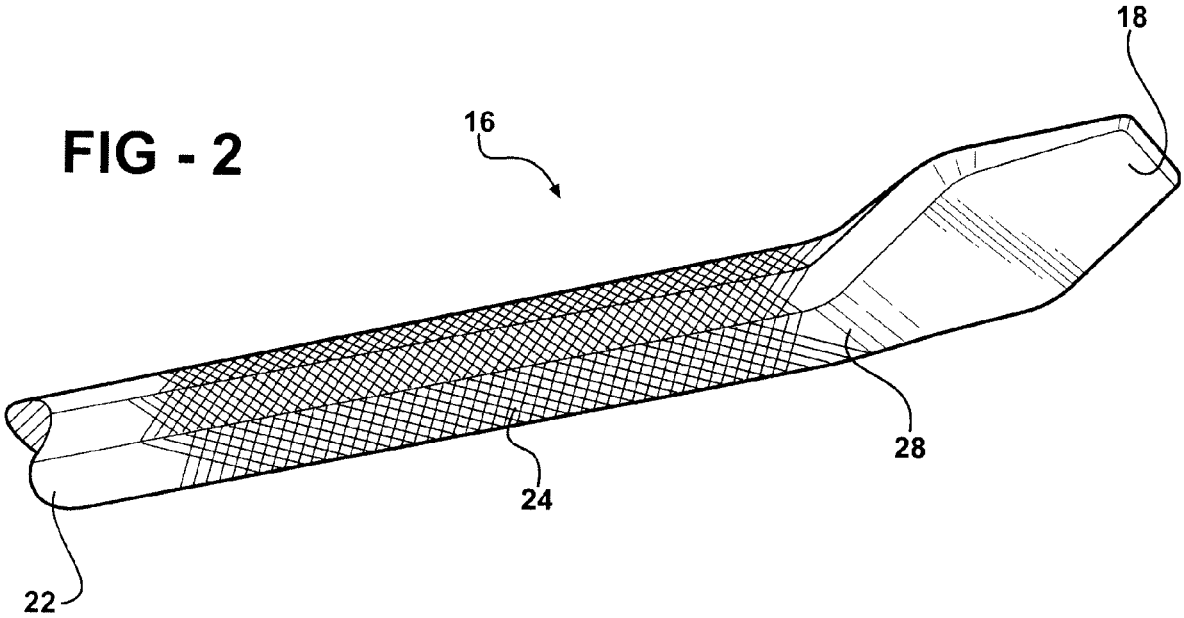
FIG. 2 is a fragmentary, enlarged view of the tip of the pry bar according to FIG. 1 and illustrating the roughened surface.

The flat faces of the shaft 22, most notably adjacent the tip 18, will be foreseeably used to establish a fulcrum when applying leverage by the application of force at the end of the handle portion 20. In order to prevent slippage of the shaft 22 from its purchase, at least one, and more preferably at least three, of the flat faces of the shaft 22 include a roughened surface 24 to increase their coefficient of friction. In the embodiment illustrated in FIGS. 1 and 2, the roughened surface 24 comprises knurls or a tooth pattern that has been cut, ground, stamped, forged or otherwise introduced into the base material of the shaft 22. These grooves preferably overlap one another in a crisscrossing pattern. Although, any knurling or roughening pattern known and used in the tool industry may be applied here with some degree of effectiveness.

Figure 3:
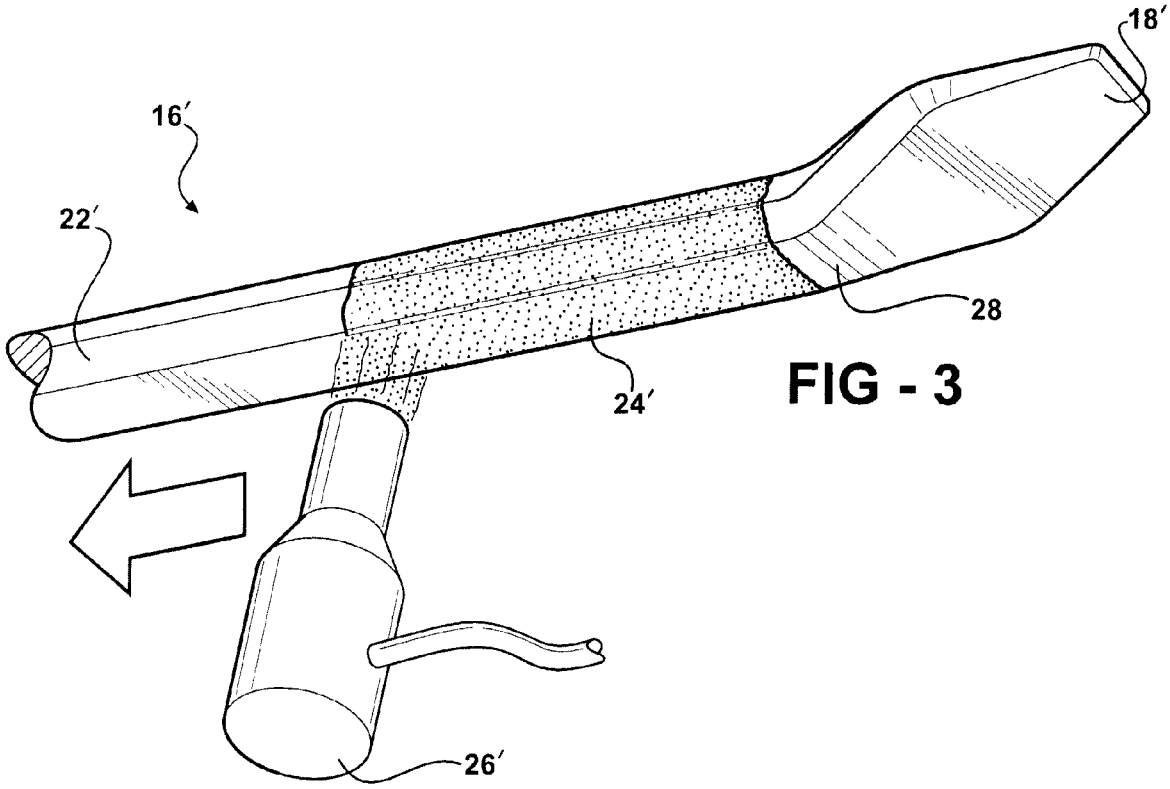
FIG. 3 is a fragmentary view of the tip of a pry bar according to an alternative embodiment of this invention, wherein a coarse thermal spray coating is applied to the shaft as a method of forming the roughened surface.

FIG. 3 illustrates an alternative embodiment of the invention, wherein like numerals corresponding to those introduced previously are used with a prime designation for the sake of convenience. Thus, according to FIG. 3, the roughened surface 24' is achieved as an applied coating, and more particularly as a thermal spray coating, using a thermal spray gun 26' according to techniques well known in the art. Thermal coating methods of this type may include plasma coating, flame spray coating, and any and all variations and similar techniques.

One or some or all of the flat faces of the shaft 22, 22' can include the roughened surface 24, 24'. In applications where the shaft 22, 22' includes at least four flat faces, such as any case of square and hexagonal geometries, at least three of those flat faces can include the roughened surface 24, 24'.

The tip 18, somewhat akin to the shaft 22, has a cross-sectional geometry comprising at least four flat sides in the preferred embodiment. This is usually achieved in a forging operation or other metal deforming technique wherein the stock of the shaft 22 is reshaped to form a flattened, blade-like tip 18. During this process, the tip 18 is angled relative to a longitudinal extent of the shaft 22, thereby forming an elbow 30 in the transition between shaft 22 and tip 18. Naturally, because the tip 18 is canted or obliquely oriented relative to the longitudinal extent of the shaft 22, the elbow 28 develops both convex (outside) and concave (inside) surface features. The roughened surface 24 may extend over the elbow 28 including, preferably at least its convex feature. When the tip 18 is comprised of at least four flat sides, it is possible to cover at least one, and more preferably at least three, of those flat sides with the roughened surface 24.

Referring now to FIGS. 4-7, an enhanced feature of the subject invention includes a slip cover, generally indicated at 30, that is employed as a protective sleeve to shield delicate objects from the harsh abrasiveness of the roughened surface 24. The slip cover 30 is preferably made from a non-marring material such as plastic, high density rubber or other composition capable of maintaining a generally rigid shape yet being resiliently re-formable. The slip cover 30 is slidably disposed along the shaft 22 toward and away from the elbow 28 so as to selectively cover at least a portion of the roughened surface 24 in desired circumstances. For example, if it is needed to establish a fulcrum against an object having a finished, painted or chromed surface, or a soft, easily marred surface, the slip cover 30 can be used as a buffer. In one preferred embodiment, the slip cover 30 is fabricated from a thermo-plastic nylon material.

Figure 4:
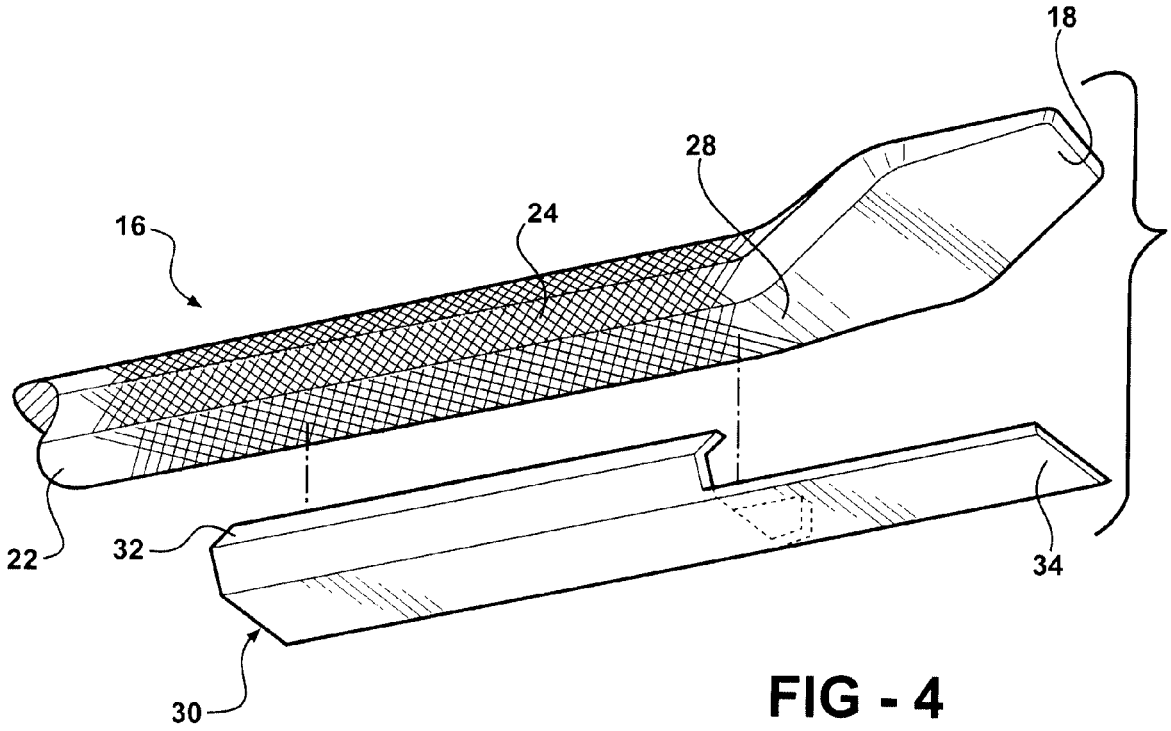
FIG. 4 is a fragmentary view of the tip portion of a pry bar according to the invention, and illustrating in exploded fashion a slip cover which can be positioned along the shalt to protect delicate surfaces from damage.
Figure 5:
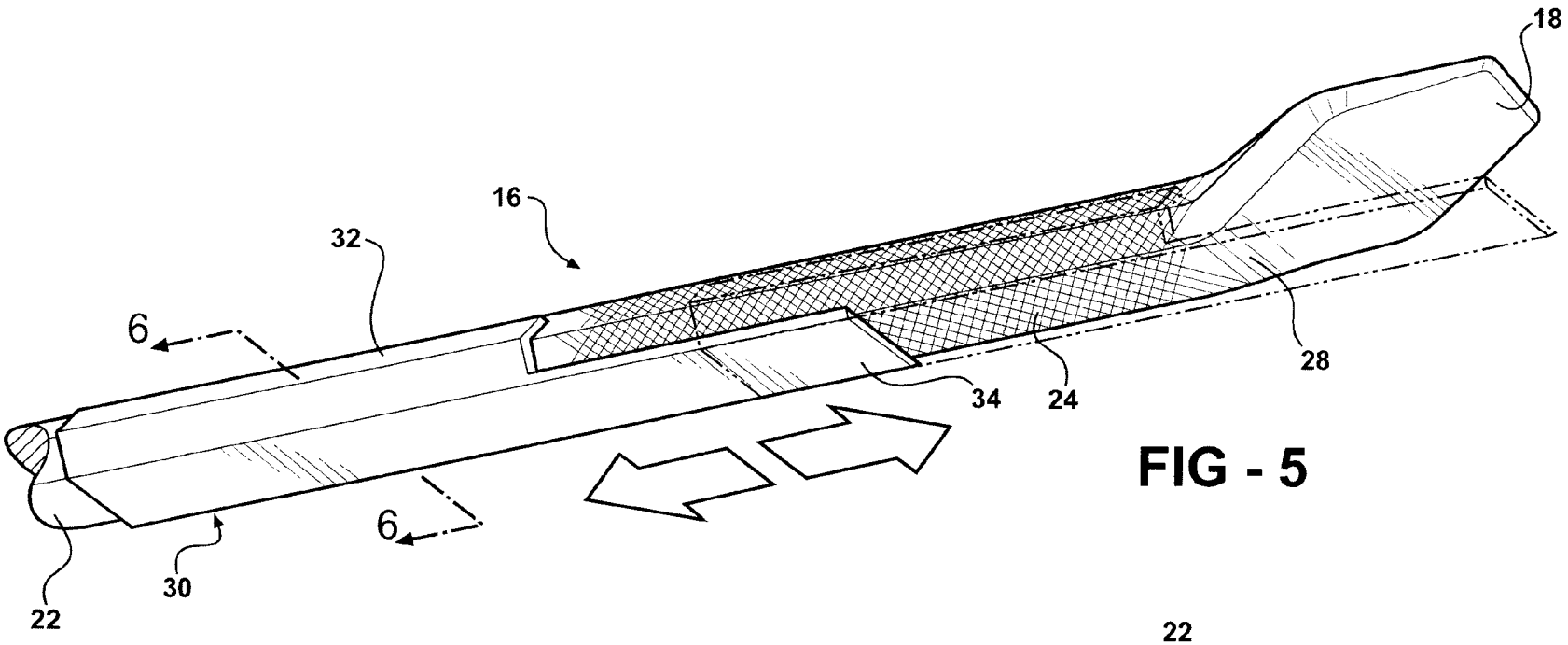
FIG. 5 is a view as in FIG. 4 showing the slip cover moved along the shaft between intervening and non-intervening positions relative to the roughened surface.
Figure 6:
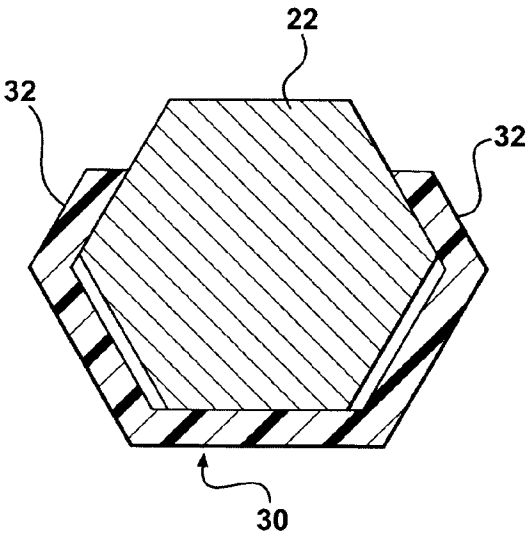
FIG. 6 is a cross-sectional view taken generally along line 6-6 in FIG. 5.

The slip cover 30 depicted in FIGS. 4-6 is merely exemplary of one of many forms which may be devised to accomplish the stated purpose. In this example, wherein the cross-sectional shape of the shaft 22 is hexagonal, the slip cover 30 is shown including a complementary shape. More specifically, depending sides 32 snap over the shaft 22 for a secure but moveable positioning. These sides 32 establish a generally U-shaped body portion that is configured to frictionally grip the shaft 22 with a light frictional fit so that the slip cover 30 tends to maintain any position along the shaft 22 to which it is moved. Thus, as shown in FIG. 5, the slip cover 30 can be slid along the shaft 22 to a retracted position for storage, for example near the handle portion 20. In other words, the slip cover 30 can be slid out of the way for utilizing the roughened surface 24 when a protective, intermediate buffer is not required.

Figure 7:
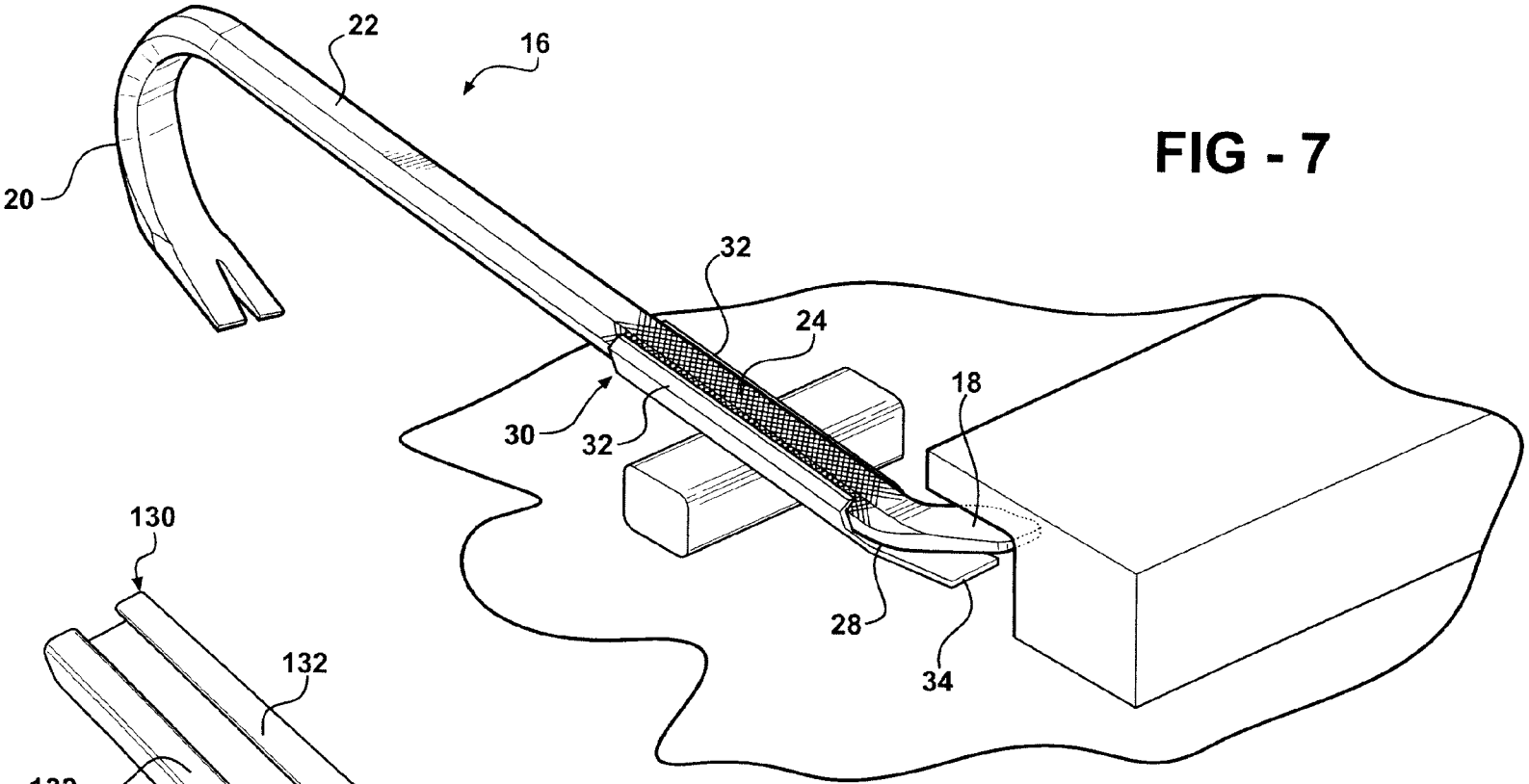
FIG. 7 is an illustrative view depicting the pry bar of FIG. 1 in use with the slip cover in a protective, intermediary position.

The slip cover 30 may include a flexible tongue 34 that, when properly positioned, can extend around the elbow 28. Thus, as illustrated in FIG. 7, the tongue 34 helps protect the convex feature of the elbow 28 in situations where the protective sleeve is needed. Preferably, the tongue 34 is an integral extension of the slip cover 30. However, those of skill in the art will envision other configurations, including a composite construction wherein the sides 32 and tongue 34 are fabricated from dissimilar materials.

FIGS. 8-13 depict an alternative configuration for the pry bar 116. For convenience in referring to similar components, like or corresponding reference numerals to those presented above are reused here but offset by 100. In this embodiment, the pry bar 116 is represented as a shorter, special use type pry bar including a plastic over-molded handle portion 120 and a shaft 122 having a generally square cross-sectional geometry. Also in this embodiment, the optional slip cover 130 is configured to fit the square shaft 122. As in the preceding example, the slip cover 130 has a generally U-shaped cross-section to enable rapid attachment/detachment to the shaft 122 as needed. The light frictional grip established by the sides 132 of the slip cover 130 gently press against the flat faces of the shaft 122 in a manner quite similar to that described in the earlier embodiment. Although not shown, the outer surfaces of the slip cover 130 may be textured or knurled or otherwise roughened so as to increase grip.

Figure 9:
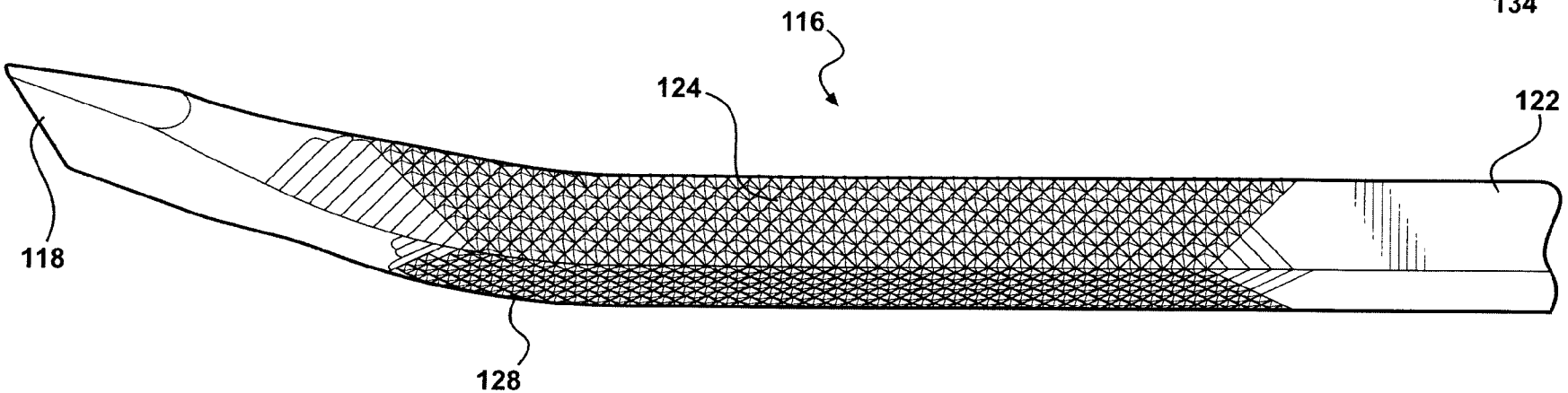
FIG. 9 is an enlarged, fragmentary view of the tip portion of the pry bar as shown in FIG. 9.

FIG. 9 depicts the roughened surface 124 along the sides and bottom of the shaft 122, covering at least three sides of the elbow 128 and a portion of the angled tip 118.

Figure 10:
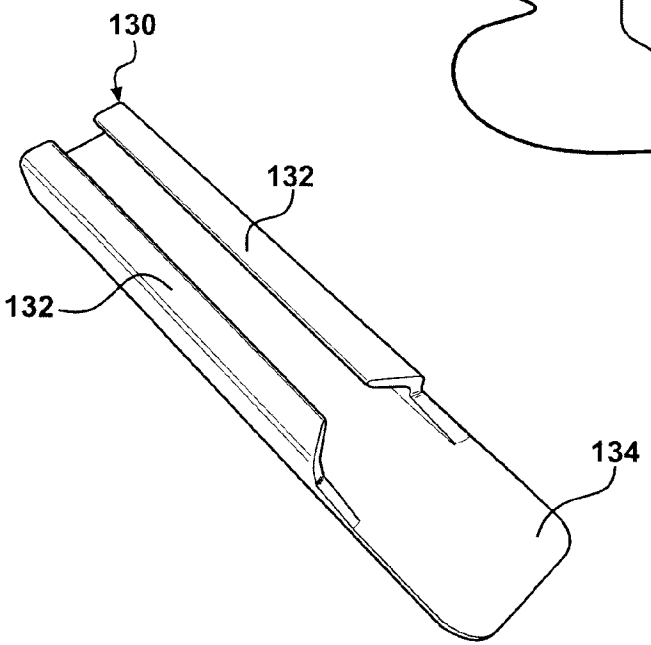
FIG. 10 is a perspective view of the slip cover for the pry bar of FIG. 8.
Figure 8:
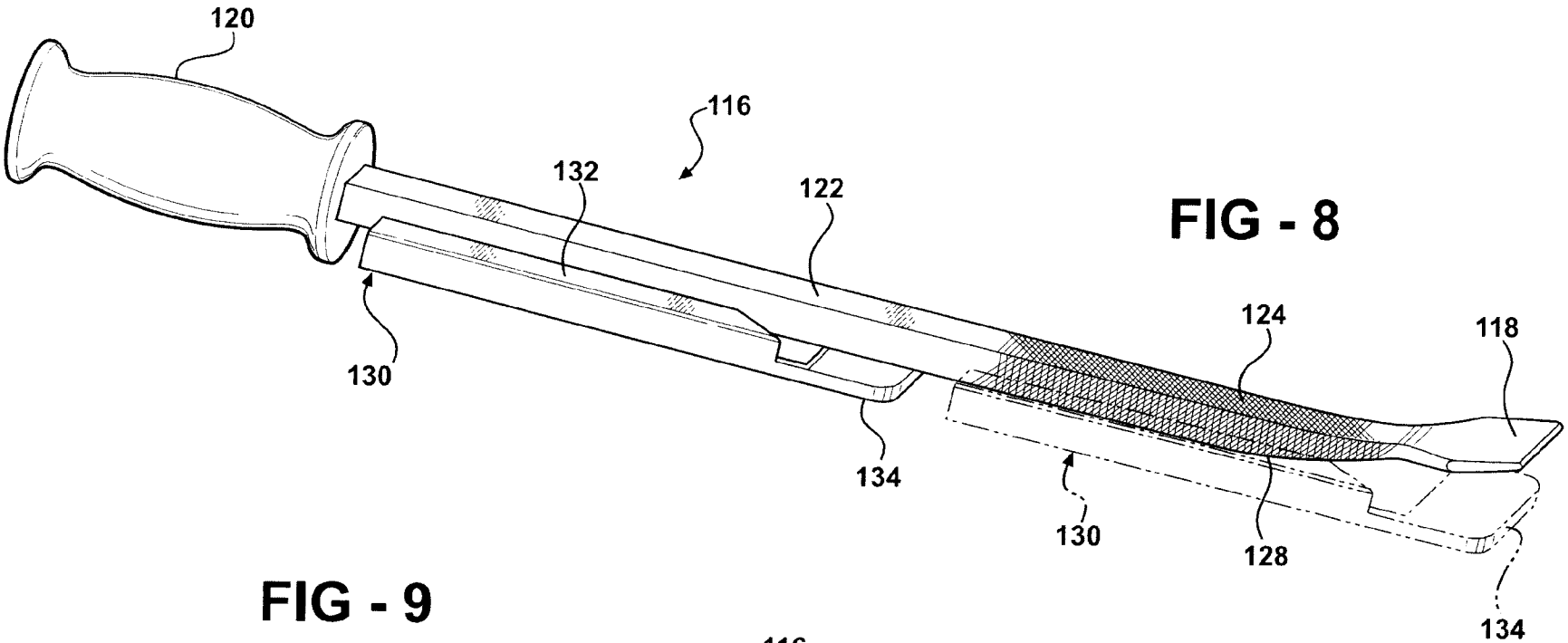
FIG. 8 is a perspective view of an alternative configuration for the pry bar tool according to this invention including a protective slip cover.

In FIG. 10, an enlarged view of the modified slip cover 130 is shown including a resilient, cantilevered tongue 134 which functions in a manner substantially similar to that described above in connection with the first embodiment. Here, the slip cover 130 is formed as an elongated tubular construction having a generally square cross-section to correspond with the square shaft 122. The slip cover 130 can be slid along the shaft 122 to any position and held there by a frictional interference fit. Alternatively, the slip cover 130 may be locked in place with an appropriate set screw, wedge, pin or other such device (not shown).

Figure 11:
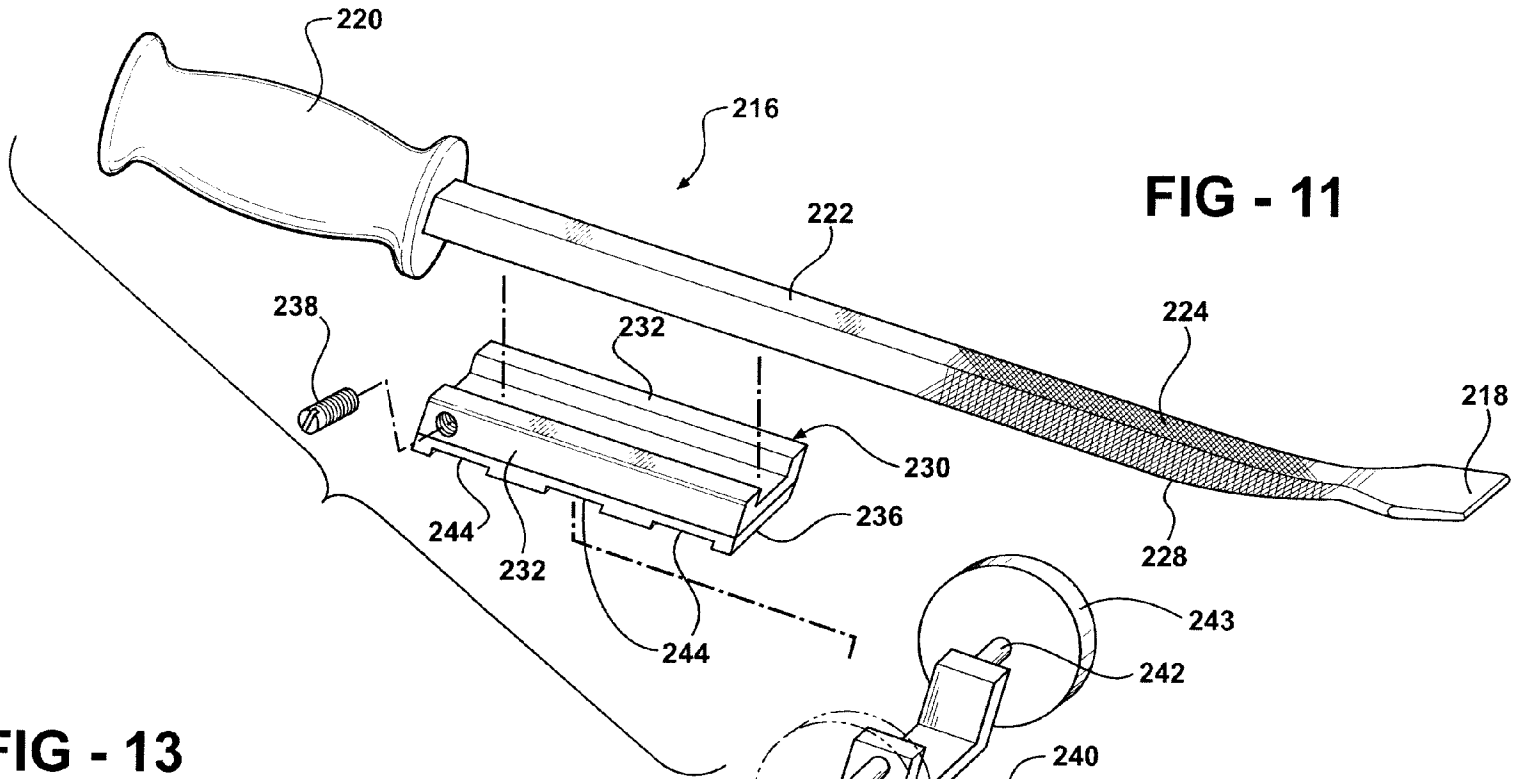
FIG. 11 is an exploded view of an alternative configuration for the slip cover along with a supplemental journaling member that is selectively interlockable therewith.

FIG. 11 illustrates a modified form of the slip cover 230, wherein similar reference numbers introduced earlier are offset by 200 for convenience. In this example, the body portion of the slip cover 230 includes rigid sides 232 forming a generally U-shaped construction. A non-marring pad 236 may be applied to the bottom surface of the slip cover 230. In this embodiment, the slip cover 230 takes the form of an intermediate adapter that can be locked in position along the length of the shaft 222 through means of a locking device 238. The locking device 238 is shown in FIG. 11 comprising a simple set screw, but those of skill in the art will envision alternative features that may include wedges, cans, pins or other such techniques.

A supplemental journaling member, generally indicated at 240, is selectively interlockable with the slip cover 230 to provide added functionality. In the example of FIG. 11, the supplemental journaling member 240 comprises a cradle that attaches directly to the slip cover 230. The cradle has a generally U-shaped body with a horizontal cross member and vertical upstanding sides. The upstanding (vertical) sides of the cradle support opposing axles 242 for receiving rollers 243 that can be used to enhance mobility of the pry bar 216 in a levering operation. The cradle can be moved to an ideal location along the shaft 222 and then locked in position using a set screw or other locking device. The slip cover 230 may include at least one interlock feature 244 for docking the supplemental journaling number 240 in a predetermined location.

As illustrated in FIG. 11, the interlock feature 244 may comprise one, or preferably a plurality, of transversely extending recesses along the bottom edge of the slip cover 230. In this example, the transverse recesses 244 are formed in the non-marring pad 236, but in other configurations may be formed directly into the body of the slip cover 230. The transversely extending recesses 244 are dimensioned to receive the horizontal cross member of the cradle in a snug, mating fit. Of course, other interlocking feature configurations can be envisioned as alternatives to the transverse recesses such as slide locks, twist locks, threaded fasteners, and the like. In another version of this invention (not depicted), the U-shape of the cradle body can be reconfigured into a generally square shape, open in the middle and having a pair of horizontal cross members interconnecting the vertical upstanding members. In this latter version, the open middle of the square cradle body is dimensioned large enough so that the pry bar shaft 222 and the slip cover 230 can slide through open middle of the square cradle body. Thus, the elevation of the wheels 243 relative to the shaft 222 can be changed by choosing to seat either the upper or lower cross member in the recess 244 of choice. In this manner, leverage and positioning can be adjusted to suit the need.

Figure 12:
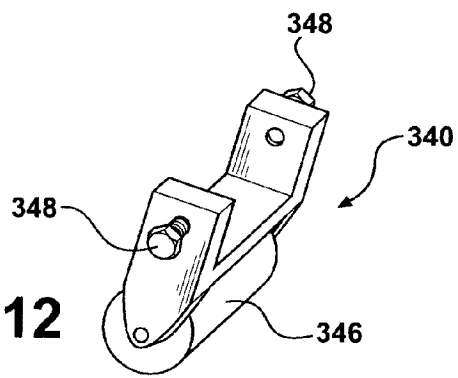
FIG. 12 is a perspective view of yet another alternative supplemental journaling member which replaces that depicted in FIG. 11 and includes a roller member.
Figure 13:
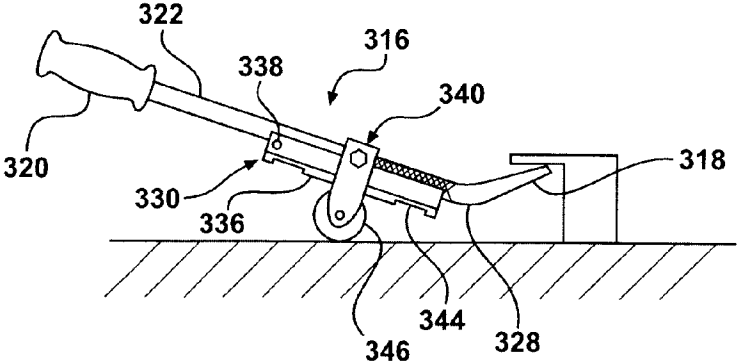
FIG. 13 is a simplified, illustrative view depicting the pry bar tool of FIGS. 11 and 12 in use.

FIGS. 12 and 13 depict yet another variation of the subject invention, wherein like or corresponding reference numerals are reused but offset by 300. In this example, the supplemental journaling member 340 is fitted with a roller 346 carried at the bottom of the device to provide a rolling interface as illustrated in FIG. 13. The supplemental journaling member 340 is shown here including a set screw 348 for attaching to the slip cover 340. In both this version and in the prior embodiment, the slip cover 230, 330 serves as a protective sleeve when used by itself, i.e., without the supplemental journaling member 240, 340.

FIG. 14 shows a still further variation of the subject invention. In this figure, like or corresponding features to those presented earlier are identified with corresponding reference numerals offset by 400. Here, the pry bar 416 takes the form of an alignment bar including a straight tapering shaft 422 terminating in a pointed handle portion 420. The tip 418 together with the elbow 428 form a hook-like configuration, giving the entire pry bar 416 a generally "J" shape. In this embodiment, the roughened surface 424 is disposed along the convex feature of the elbow 428 for increasing the coefficient of friction when applied against a fulcrum. This embodiment serves therefore as an example of those classes of pry bar tools which are intended to be used in levering operations, where only the elbow 428 is likely to be used as the purchase point. In these circumstances, it is only necessary to place the roughened surface 424 over the convex portion of the elbow 428. Of course, the roughened surface can be extended over neighboring surfaces of the elbow 428, and indeed even over the tip 418 and/or portions of the shaft 422 if so desired. Similar to an earlier description, the U-shape of the cradle body can be reconfigured into a generally square shape, open in the middle and having a pair of horizontal cross members interconnecting the vertical upstanding members. In this alternative version, the open middle of the square cradle body is dimensioned large enough so that the pry bar shaft 322 and the slip cover 330 can slide through open middle of the square cradle body. Thus, the elevation of the wheel 346 relative to the shaft 322 can be changed by choosing to seat either the upper or lower cross member in the recess 344 of choice.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A pry bar comprising:

a handle portion;

an elongated shaft extending from said handle portion;

a working tip extending from said shaft opposite said handle portion, said tip being angled relative to the longitudinal extent of said shaft and extending out of a plane of said shaft with an elbow forming a transition between said shaft and said tip;

and said shaft including a roughened surface disposed along at least a portion thereof adjacent said elbow for increasing the coefficient of friction when said shaft is applied against a fulcrum and a non-roughened surface portion between said roughened surface portion and said handle portion.

2. The pry bar of claim 1 wherein said roughened surface comprises a pattern of overlapping grooves.

3. The pry bar of claim 1 wherein said roughened surface comprises an applied coating.

4. The pry bar of claim 1 further including a slip cover slidably disposed along said shaft toward and away from said elbow for selectively covering at least a portion of said roughened surface.

5. The pry bar of claim 4 wherein said slip cover includes a flexible tongue configured to overlap said elbow.

6. The pry bar of claim 5 wherein said slip cover includes a resilient, generally U-shaped body portion configured to frictionally grip said shaft.

7. The pry bar of claim 4 further including a supplemental journaling member selectively interlockable with said slip cover.

8. The pry bar of claim 7 wherein said supplemental journaling member includes a roller wheel.

9. The pry bar of claim 7 wherein said slip cover includes a locking device for securely attaching to said shaft.

10. The pry bar of claim 9 wherein said locking device includes a set screw.

11. The pry bar of claim 7 wherein said slip cover includes at least one interlock feature for docking said supplemental journaling member in a predetermined location.

12. The pry bar of claim 11 wherein said interlock feature includes a transversely extending recess along a bottom edge of said slip cover.

13. The pry bar of claim 1 wherein said elbow has convex and concave surface features, and wherein said roughened surface covers said convex feature of said elbow and at least a portion of said tip.

14. The pry bar of claim 13 wherein said shaft has a generally continuous cross-sectional geometry comprising at least four flat faces, and wherein at least three of said flat faces include said roughened surface.

15. The pry bar of claim 13 wherein said tip has a cross-sectional geometry comprising at least four flat sides, and wherein at least three of said flat sides include said roughened surface.

16. A pry bar comprising:

a handle portion;

an elongated shaft extending from said handle portion;

a working tip extending from said shaft opposite said handle portion, said tip being angled relative to the longitudinal extent of said shaft with an elbow forming a transition between said shaft and said tip;

said shaft including a roughened surface disposed along at least a portion thereof adjacent said elbow for increasing the coefficient of friction when said shaft is applied against a fulcrum; and a slip cover slidably disposed along said shaft toward and away from said elbow for selectively covering at least a portion of said roughened surface, said slip cover including a body portion and a flexible tongue extending from said body portion and configured to overlap said elbow.

17. The pry bar of claim 16 wherein said body portion is generally U-shaped and configured to frictionally grip said shaft.

18. The pry bar of claim 16 wherein said elbow has convex and concave surface features, and wherein said roughened surface covers said convex feature of said elbow and at least a portion of said tip.

19. The pry bar of claim 18 wherein said shaft has a generally continuous cross-sectional geometry comprising at least four flat faces, and wherein at least three of said flat faces include said roughened surface.

20. A pry bar comprising:

a handle portion;

an elongated shaft extending from said handle portion;

a working tip extending from said shaft opposite said handle portion, said tip being angled relative to the longitudinal extent of said shaft and extending out of a plane of said shaft with an elbow forming a transition between said shaft and said tip, said elbow having convex and concave surface features;

said elbow including a roughened surface disposed along at least said convex feature thereof for increasing the coefficient of friction when applied against a fulcrum and a non-roughened surface portion between said roughened surface portion and said handle portion.

* * * * *